US006561359B2

(12) United States Patent
Egge et al.

(10) Patent No.: US 6,561,359 B2
(45) Date of Patent: May 13, 2003

(54) METHOD AND APPARATUS FOR REMOVING LIGHTWEIGHT PARTICULATES DURING PROCESSING OF A PRIMARY MATERIAL

(75) Inventors: Alan R. Egge, Yankton, SD (US); Stephen Anderson, Yankton, SD (US)

(73) Assignee: Astec Industries, Inc., Chatanooga, TN (US)

( * ) Notice: Subject to any disclaimer, the term of this patent is extended or adjusted under 35 U.S.C. 154(b) by 34 days.

(21) Appl. No.: 09/796,939

(22) Filed: Mar. 1, 2001

(65) Prior Publication Data

US 2002/0121463 A1 Sep. 5, 2002

(51) Int. Cl.[7] ..... B07B 9/02; B07B 11/06

(52) U.S. Cl. ..... 209/44; 209/13; 209/12.1; 209/17; 209/18; 209/454; 209/455

(58) Field of Search ..... 209/44, 12.1, 13, 209/17, 18, 454, 455, 457, 488, 489, 190, 491, 492, 494, 495, 496, 500, 309, 320, 311, 313, 156, 157, 172, 172.5, 173

(56) References Cited

U.S. PATENT DOCUMENTS

| | | | | | |
|---|---|---|---|---|---|
| 3,640,383 | A | * | 2/1972 | Wantling | 209/17 |
| 3,682,299 | A | | 8/1972 | Conley et al. | |
| 3,913,788 | A | | 10/1975 | McCauley | |
| 4,199,080 | A | | 4/1980 | Keeney | |
| 4,340,469 | A | | 7/1982 | Archer | |
| 4,444,656 | A | | 4/1984 | Nelson | |
| 4,707,249 | A | | 11/1987 | Apeland | |
| 4,717,470 | A | | 1/1988 | Apeland | |
| 4,732,670 | A | | 3/1988 | Nelson | |
| 4,906,352 | A | | 3/1990 | Nelson | |
| 5,232,099 | A | | 8/1993 | Maynard | |
| 5,240,114 | A | | 8/1993 | Parker | |
| 5,524,767 | A | * | 6/1996 | Kumagai et al. | 209/44 |
| 5,818,732 | A | | 10/1998 | Vandewilt | |
| 5,950,839 | A | | 9/1999 | Wedel | |
| 5,957,301 | A | | 9/1999 | Wedel | |

* cited by examiner

*Primary Examiner*—Donald P. Walsh
*Assistant Examiner*—Jonathan R Miller
(74) *Attorney, Agent, or Firm*—Moore & Hansen

(57) ABSTRACT

An apparatus and method for removing lightweight particulates during processing of a primary material. The apparatus includes a classification tank having an inlet, an outlet and a plurality of settling stations located therebetween. A slurry of fluid and particles is introduced into the inlet and directed towards the outlet. As the slurry traverses along the classification tank, particles come out of suspension at the settling stations according to weight and to a lesser degree, density. The composition as well as the quantity of particles at the settling stations is periodically inspected. If particles deposited at a particular settling station are more or less the same size, and if they have accumulated in sufficient quantity, they are discharged to a flume which directs them to preselected collection areas. If the particles deposited at a particular settling station vary substantially in size, which would indicate the presence of lightweight material, and if they have accumulated in sufficient quantity, they are discharged to a different flume or flumes which directs them to a screen or screens prior to directing them to preselected collection areas.

43 Claims, 4 Drawing Sheets

METHOD AND APPARATUS FOR REMOVING LIGHTWEIGHT PARTICULATES DURING PROCESSING OF A PRIMARY MATERIAL

FIELD OF THE INVENTION

This invention relates generally to a system for sorting particulate material. More particularly, this invention pertains to a method and an apparatus for separating a mixture of particles according to specific gravity.

BACKGROUND OF THE INVENTION

One specific purpose of the invention is to remove lightweight deleterious impurities such as particles of coal from sand destined for use in concrete and mortar and bring the level of such deleterious material down to an acceptable level. There is an ongoing need for reasonably clean sand in order to provide essential ingredients for concrete, mortar and asphalt products. Typically medium sized sand is used for concrete, a finer mix for mortar and a combination of sizes for asphalt. When sand is quarried from deposits in a raw form, it usually contains unwanted components including rocks of various sizes, vegetable matter, clay, silt, slime and various lightweight materials inter alia coal (anthracite and lignite) and shale. All these materials generally need to be removed. It is particularly important, for several reasons, to remove lightweight particles such as coal when the sand is destined for use in concrete and mortar. The primary reason is that coal is a significantly softer material than sand. If not removed, the hardened concrete or mortar will have the coal particles therein, and these particles quickly erode and degrade resulting in voids within or on the surface of the finished concrete or mortar. These voids fill with water, and freezing and melting cycles can quickly degrade the concrete or mortar. The coal is also more porous than sand and tends to absorb water even before degrading, thus promoting destructive freezing and melting cycles and early damage to the concrete or mortar. Additionally, the coal also tends to smear when the concrete is worked and tooled, causing unsightly black streaking of the concrete or masonry surface. These problems make it important to remove the coal during the cleaning cycle.

State of the art sand processing begins with the quarried, raw sand being run through one or more conventional, superposed screens having decreasing mesh openings in which rocks of various sizes, vegetable matter, and any other fairly large impurities are separated from the raw sand. During this screening, a working fluid is often added to the raw sand to form a slurry. With sand processing, the working fluid will be water. The slurry produced during this preliminary step is next directed to a classification tank in which the raw sand is allowed to settle to the bottom of the classification tank and the lighter clay, silt, and slime is washed away with the water.

Generally, classification tanks are rectangular and include an inlet end, an outlet end and a plurality of settling stations (typically 7–11) positioned between the inlet and outlet ends along a bottom surface. There are usually no physical dividers between these stations, and the first two to three stations at the inlet end will be spaced more closely to each other than will the last stations at the outlet end of the tank. The raw sand, after being preliminarily screened and washed as described above, will be directed into the classification tank in a slurry form, entering the tank at a predetermined rate. As the slurry moves along the classification tank, the raw sand carried by the slurry is transported along the classification tank with the heaviest sand particles dropping to the bottom at the first two or three settling stations and the medium and smaller sand settling at subsequent settling stations. Clay, slime and silt tend to remain in suspension and are carried away by the water flow as it exits the outlet end of the classification tank.

Each settling station is usually operatively connected to three drainpipes, and each of these pipes discharge to one of three distinct and adjacent flumes positioned beneath the tank. The drainpipes at these settling stations are normally kept closed by remotely operated valves and the valves are opened at predetermined times to discharge the accumulated sand particles of that station. A control system determines which of the three valves at each settling station to open, and as a result the collected sand at that station may be directed to a particular flume. For example, the coarsest particles may be directed to the first flume, the medium particles directed to the second flume and the fine particles directed to the third flume.

Until the present invention, it was quite challenging to remove lightweight impurities from the slurry, and previous attempts to do so proved less than satisfactory. In one attempt, a jig that was used to separate lightweight particulate matter from larger, stone sized particles was modified for use with smaller, sand sized particles. A typical jig consists of a nearly horizontal bed over which a very shallow flow of slurry is directed. As the slurry traverses the bed, the bed is vibrated, and this vibration causes the lightweight material to rise to the top of the slurry. When the slurry reaches the end of the bed, the lightweight material is skimmed off from the upper portion of the slurry by a knife the desirable particles are allowed to pass beneath. The knife adaptation of this device for sand sized particles has met with only limited success. For example, the capacity of such a modified jig is inherently limited because if the slurry is too deep, the lightweight particles will not be able to be brought up to the surface by the vibrating bed. Conversely, it is not very efficient to have a relatively shallow slurry depth because only small amounts of material may be processed. Moreover, such a modified jig is a complicated and expensive piece of equipment that is costly to operate. Additionally, and more importantly, such a jig is unable to effectively fractionate the raw sand feed material and process only that portion in which lightweight particles are concentrated.

Another apparatus known to the art to separate lightweight particles from denser particles used a density separator. A density separator is a device that also operates on the principle of floatation. A typical density separator is a large, square, open-top tank having a bottom with a single discharge valve. The open top of the tank includes weirs over which a working fluid and suspended material is permitted to flow. A slurry is introduced into the tank and fills it to overflowing. By adjusting the flow rate, it is possible to suspend and remove lightweight material as the upwelling fluid flow passes over the weirs. This overflow is typically passed over a static screen to remove larger lightweight materials, and the finer material and working fluid which pass through the screen may be directed to other areas for further processing. The coarser material settles to the bottom of the tank and is periodically directed to other areas for further processing. As with the aforementioned modification of an existing jig, use of a density separator to separate and remove lightweight materials from smaller, sand sized particles has met with limited success. Capacity is limited. For example, if the slurry is inputted in to the tank at too great a rate, both undesirable and desirable material may flow over the weirs and onto the screen. All of this discharge tends to clog the screen and reduce its efficiency. Moreover, not all of the lightweight material is effectively separated from the sand particles, and lightweight material can become trapped along with the coarser particles which settle at the bottom of the tank. If the slurry is inputted too slowly, it will not be possible to induce all of the lightweights to flow over the weirs and excessive lightweight material settles at the bottom of the tank along with the coarser sand particles. This is not only limiting, it is also inefficient. Another inefficiency occurs at the single screen through which all of the overflow material is directed. And, as with the modified, aforementioned jig, this device is unable to fractionate the raw feed material and process only that portion in which lightweight particles are concentrated. That is, there is no effective way to control the settling patterns of the particulate material as it settles on the bottom of the tank, and there is no provision to process portions of the settled particulate matter differently.

Yet another attempt, a field retrofit, used a classification tank in conjunction with a single static wire cloth screen through which all of the material drained from a predetermined settling station was directed. This had several drawbacks. It was not very efficient because the lightweight material prevented the desirable sand particles from passing thereby and tended to attract particles of sand to form clumps which further clogged the screen. This reduced the processing speed and efficiency of the screen and required repeated and frequent down time to unclog. Moreover, not all of the sand needed to be screened, which also contributed to the reduced processing efficiency of the screen.

In an attempt to reduce the clumping and clogging, the aforementioned static screen was vibrated by a motor that was operatively connected thereto, and which rotated at a rate of around 1,000 revolutions-per-minute (RPM). This improved the processing efficiency of the screen somewhat by reducing clumping and clogging, and with it some of the lightweight contaminants were separated from the sand. However, it was observed that the resultant end product still contained significant lightweight contaminants. More importantly, these lightweight contaminants were now mixed with the end product and were now more difficult to remove from the end product and required additional, costly and time-consuming processing.

Both of these attempts also were unable to fractionate the raw material and these structures processed only a single settling station where lightweight materials were seen to be more concentrated.

SUMMARY OF THE INVENTION

The invention includes an apparatus and method for sorting a mixture of particles according to weight and size. The apparatus includes a classification tank having an inlet, an outlet and a plurality of settling stations located therebetween. A slurry of working fluid and particles is introduced into the inlet and directed towards the outlet. As the slurry traverses along the classification tank, particles come out of suspension and settle at the settling stations according to weight and to a lesser degree, density. Thus, the heavier particles tend to settle out before the medium and fine particles, as in a continuum. The composition as well as the quantity of particles that have settled at the settling stations is periodically inspected. If particles deposited at a particular settling station are approximately the same size, and if they have accumulated in sufficient quantity, they are allowed to discharge downwardly therefrom into a flume which directs them to preselected collection areas.

While the invention may be utilized with a number of different lightweight contaminants to remove the contaminants, coal, specifically lignite and anthracite contamination is of the greatest concern. Coal has a specific gravity which is about half that of sand used in concrete and mortar. In a typical classification tank, coal particles are often heavy enough to settle to the bottom and mix with the various sand particles rather than remain in suspension. It has been observed that a coal particle which settles at any given settling station is usually about twice or more the size of the adjacent sand particles. It has also been observed that the coal particles of varying sizes carried by the slurry will settle in a similar fashion along a number of different settling stations. It has also been observed that the stations at which settling of the coal particles occurs are not wholly predictable, but with a given source of raw sand, the settling patterns are usually reasonably constant, but do need to be identified by testing. A part of the present invention includes identifying the settling stations of the classification tank at which significant lightweight particle settling occurs and then diverting the particles which settle at those settling stations to a second stage where the larger (and less dense) lightweight particles, such as coal, are separated from the sand by screening.

Thus, if the particles deposited at a particular settling station vary substantially in size, which would indicate the presence of unwanted lightweight material such as coal, and if such lightweight material has accumulated in sufficient quantity, the collected deposited material is allowed to discharge therefrom into a different flume or flumes which directs it to a screening station or stations prior to directing it to preselected collection areas.

Part of the present invention also includes equipping the classification tank with one or more rising current classifier cells which are positioned in the classification tank adjacent to the input end. Each such cell contains a grate through which an upward current of working fluid such as water may be directed. The current may be varied so that it has a flow rate which is sufficiently strong to urge the lightweights upward and away from the grate, but which is not strong enough as to prevent the heavy coarse sand from dropping downward through the grate to the bottom of the first three stations. The cells and their use are an important structure and step which immediately separates the lightweight particles from the coarse sand as the slurry enters the input end of the classification tank—and most of the sand is coarse sand. As a result, the amount of remaining sand that may require lightweight particle removal, is greatly diminished.

In removing the sand accumulated at the bottom of the settling stations, it has been found that it is desirable to treat, as a group, all the settling stations that contain medium size sand and to divert all such sand at these stations to a first flume, which will lead to a first screen where the lightweight particles associated with this first group of stations will be removed. The remaining stations where fine sand has settled will also be treated as a group, and the accumulated fine sand and lightweight particles at these stations will be discharged to a second flume, which will lead to a second and finer screen where the lightweight particles associated with those stations will be removed. The coarsest particles, which will settle out at the first three settling stations is kept relatively clear of lightweight particles by use of the classifier cells near the input end of the classification tank so as to increase upward lift and prevent even larger lightweight particles from settling there. As a result the coarse sand at settling stations 1–3 has little deleterious material therein and can be drained to a third flume and accumulated without need for further screening. The smallest sand particles, which settle near the outlet end of the classification tank will be discharged to a fourth flume and accumulated without the need for further processing. Thus configured, the apparatus and method is able process large amounts of raw material in an efficient manner while reducing the need for elaborate designs and avoiding costly equipment and operational expenses.

It is an object of the present invention to provide a system that separates particles of material by weight and size.

Another object of the invention to provide a system for separating deleterious, low density particles from primary, higher density particles.

Yet another object of the present invention is to streamline the separation process by controlling the deposition gradient in a classification tank and by determining if portions of the deposition gradient require additional processing.

A feature of the present invention is the use of at least one screen downstream of the classification tank to separate particles by size.

Another feature of the present invention is the use of sprayers to facilitate particle separation at the at least one screen.

Another feature of the invention is the predetermined orientation and vibrational characteristics of the downstream screen.

Yet another feature of the present invention is the use of an auxiliary flow of fluid to prevent the accumulation of deleterious lightweight particles at predetermined locations of the classification tank.

An advantage of the present invention is that deleterious lightweight material may be effectively and efficiently separated from a primary material.

These and other objects, features and advantages of the present invention will become apparent from the following detailed description thereof taken in conjunction with the accompanying drawing, wherein like reference numerals designate like elements throughout the several views.

BRIEF DESCRIPTION OF THE DRAWINGS

FIG. 2 is a partial, side plan view of a portion of the apparatus of FIG. 1 illustrating the juxtaposition of the elongated container unit with a trough of the classification tank, a plurality of discharge conduits and the discharge system of the first stage of the processing apparatus;

DESCRIPTION OF THE PREFERRED EMBODIMENT

Figure 1:
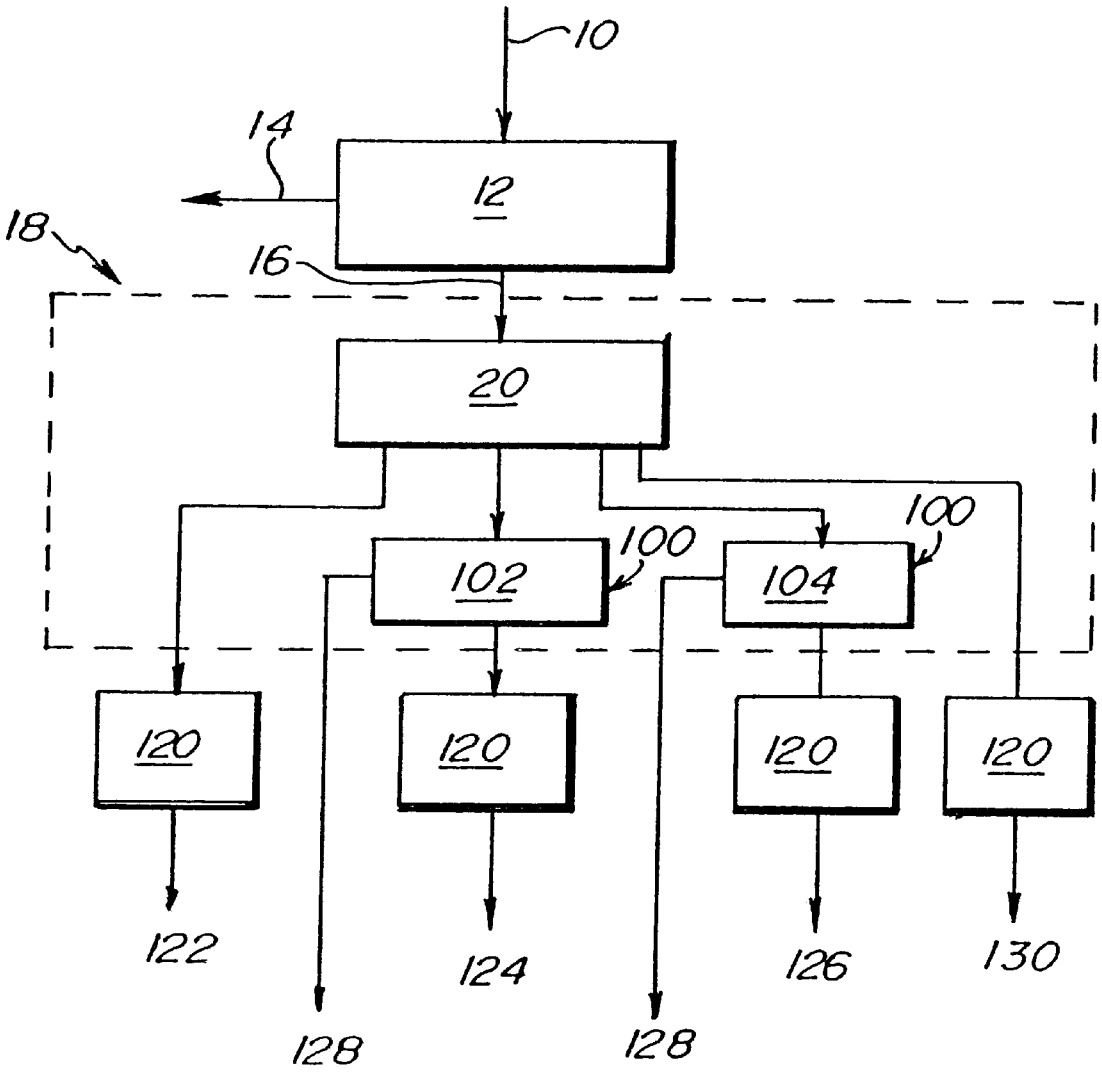
FIG. 1 is a schematic depiction of an embodiment of the particle removal processing apparatus as it relates to an initial processing unit and a plurality of dewatering units.

With reference to FIG. 1, a source of raw material 10 is introduced into an initial processing unit 12. Such raw material may be primarily sand containing various contaminants, however, it is understood that such raw material may include other particulate matter. At processing unit 12, the material 10 is screened and washed to separate rocks of varying size, vegetable matter, and any other fairly large undesirable matter 14 from the material. The undesirable matter 14 usually contains useful material such as stones and these are separated and processed for use in other applications. The remaining raw material, which includes a working fluid from the washing step, forms a slurry 16 which is then directed to the processing apparatus 18 of the present invention (depicted as the area within the dashed lines). While the preferred working fluid in this instance is water, it is understood that other fluids capable of maintaining the raw material in suspension may be used. As depicted, the processing apparatus 18 includes a first stage 20 and a second stage 100 that will be described later in greater detail. Referring now to FIG. 2, the first stage 20 of the processing apparatus 18 includes a classification tank 28. There, the raw material particles are deposited according to weight and to a lesser degree, density. Thus, the heavier, coarse particles tend to settle out before the lighter, medium and fine particles, as in a continuum. As illustrated in FIG. 1, from tank 28, the particles are either delivered directly from the first stage 20 to a dewatering unit 120 or to the second stage 100 for further treatment prior to passage through other dewatering units 120. The material that passes through the dewatering units 120 is amassed as end products 122, 124, 126, 130 at separate collection areas as end product 122, 124, 126 and 130, respectively. The lightweight materials separated from the material at the second stage 100 is collected and subsequently discarded or otherwise disposed of.

Referring again to FIG. 2, the classification tank 28 of the processing apparatus 18 includes an elongated container unit 22 and a discharge system 24 including a plurality of discharge conduits 60 connected to the bottom of the classification tank 28. Each discharge conduit 60 is provided with a valve (See, FIG. 3). The elongated container unit 22 includes a trough 30, which has an inlet end 32, an outlet end 34, and a plurality of settling stations, here illustrated as ten such stations 36 A–J positioned therealong. The slurry 16 is introduced to the trough 30 at the inlet end 32 at a predetermined flow rate suited to the tank and slurry. As the slurry 16 moves along the trough 30 from left to right, the raw sand carried by the slurry is transported along the trough 30 with most of the heaviest particles dropping to the bottom of the trough 30 at the first two or three leftmost settling stations 36A–C and the medium weight and lightest weight sand particles settling at subsequent settling stations 36D–J. Clay, slime and silt tend to remain in suspension in the working fluid and are carried away by the fluid as it exits the outlet 34A at the outlet end 34 of the trough 30. Note that the first two to three settling stations 36A–C at the inlet end 32 are spaced more closely to each other than the latter settling stations 36D–J, particularly adjacent the outlet end 34 of the trough 30. The reason for this arrangement is because particles within any given batch of slurry do not necessarily settle out in equal amounts at all of the settling stations. And, with the sand slurry used in this preferred embodiment, the majority (by weight) of desirable sand particles tend to settle out at the first few settling stations, with lesser amounts (by weight) of particles settling at the latter settling stations.

Figure 3:
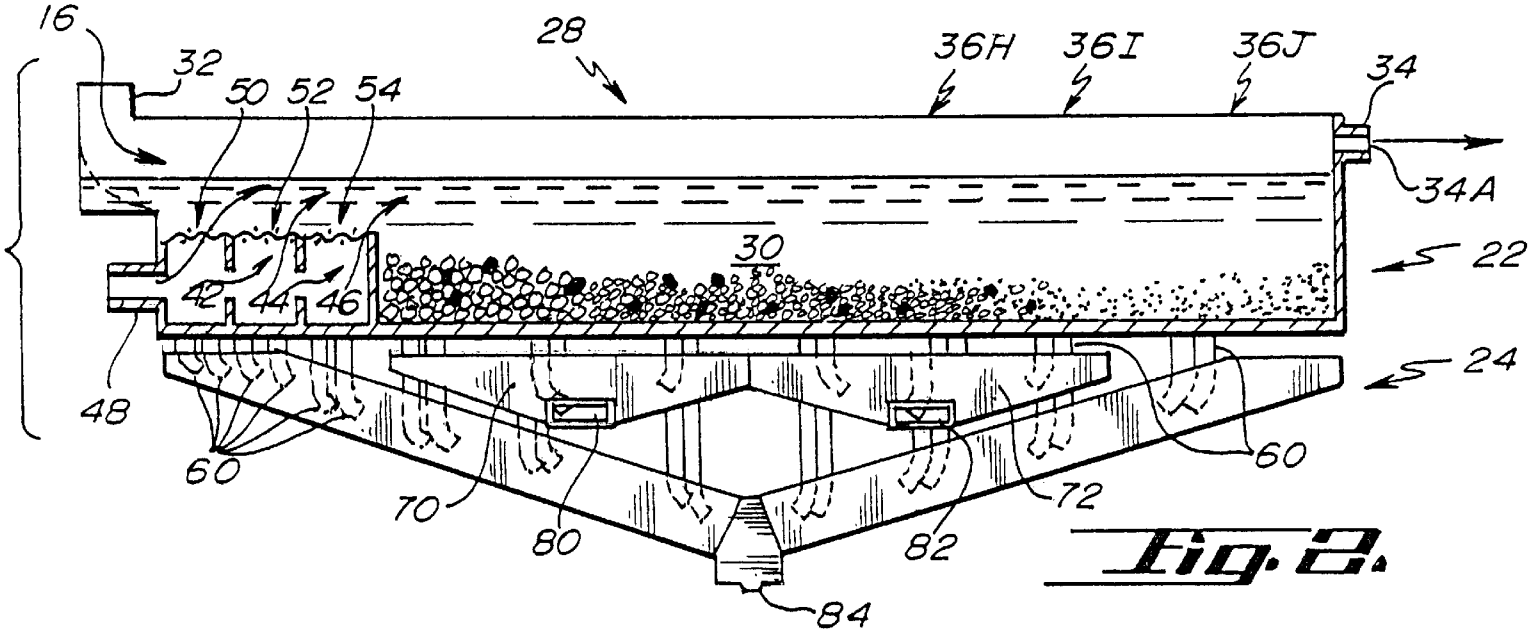
FIG. 3 is a partial side sectional view of a portion of the classification tank illustrating the location of rising current cells adjacent to the input end of the classification tank and the accumulation of particles that pass through the adjustable grates of the cells.

With reference to FIGS. 2 and 3, the trough 30 also may include one or more rising current cells 42, 44, and 46 that are located adjacent to the inlet end 32 of the trough 30. Preferably, the cells 42, 44, 46 are in communication with each other and with an input 48 into which an auxiliary flow of working fluid may be directed. A rising current classifier cell is a device that is used in conjunction with classification tanks. It is a container-like structure having an intake and an exhaust, with the exhaust including an adjustable grate. The cell is typically positioned within a classification tank at the input end thereof as an optional attachment. A separate source of working fluid is directed through the intake into the body of the cell and then out through the grate. As the working fluid is exhausted, it intercepts and combines with the slurry that is flowing into the classification tank through the classification tank inlet. This creates an area of turbulence that keeps the smaller bits of matter carried by the slurry in suspension and aids in classification.

Each cell 42, 44, 46 also includes an adjustable grate 50, 52, 54, respectively, through which a portion of the auxiliary flow of working fluid may flow. As depicted in FIG. 3, the rate of fluid flow through each grate 50, 52, 54 may be varied depending upon the composition and characteristics of the slurry 16 entering the inlet end 32 of the trough 30. When the situation calls for the use of such a cell or cells, the operator of the system will adjust the flow of each cell 42, 44, 46 so that the flow rate through the grates 50, 52, 54 is sufficiently intense to urge lightweight particles upward and away from the grates 50, 52, 54, while allowing the heavier, coarse sand particles to pass therethrough and settle to the bottom of the settling stations 36A–C therebeneath. As can be seen in FIG. 3, where the sizes of the sand particle have been exaggerated for purposes of illustration, the sand particles which have accumulated at settling station 36A are larger than the particles which have accumulated at settling station 36B and those particle are larger than the particles which have accumulated at settling station 36C, and so on. The use of rising current cells is preferred because they are an extremely effective method and apparatus for separating lightweight material from denser material. It should be understood that throughout the drawings and for purposes of illustration, the sizes of the sand particles and the lightweight particles in all the stations 36A–J have been greatly exaggerated.

Figure 4:
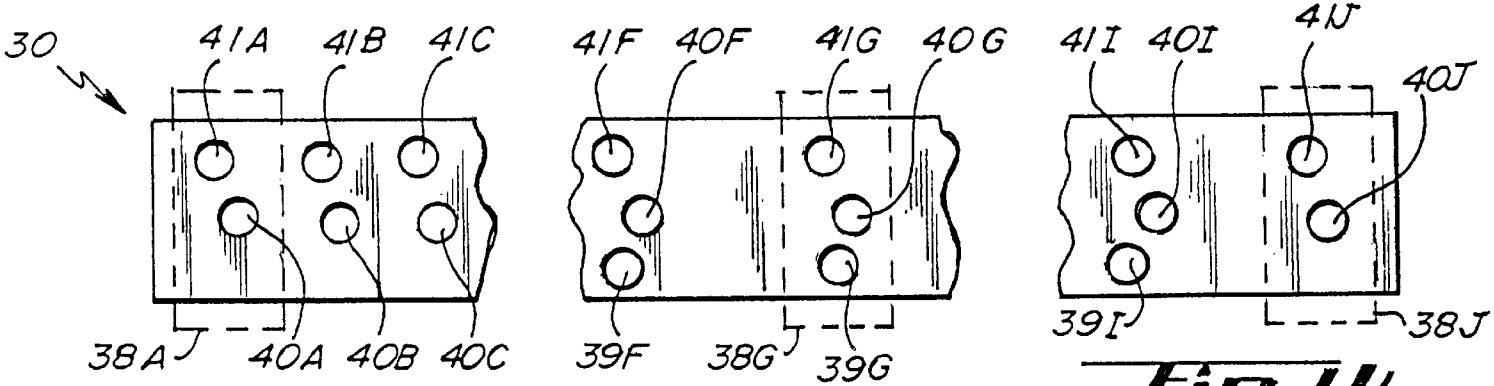
FIG. 4 is sectional, top plan view of the bottom of the classification tank that illustrates the general location of the valve assembly clusters at settling stations.

As can be seen in FIGS. 3 and 4, each settling station 36A–J includes a sensing paddle 37A–J and a valve assembly 38A–J (which includes movable valves 39A–J, 40A–J, and 41A–J, respectively) to open and close the three discharge apertures at each station through which accumulated material may be passed to the discharge conduits 60 (See, FIG. 4). As depicted, the valves at settling station numbers 36A and 36D have been opened to allow the accumulated material to pass therethrough into a discharge conduit 60, while the valves at settling stations 36B and 36C remain closed. The valves at settling stations 36A–J are normally kept closed and the valves 39A–J, 40A–J, 41A–J are opened periodically to discharge the accumulated sand particles of each particular settling station 36A–J when the sensing paddle at a station detect a significant accumulation of sand. A control system (not shown) determines which of the valves 39A–J, 40A–J, 41A–J to open, so that the classified material may discharged to an appropriate flume for further processing.

Figure 5:
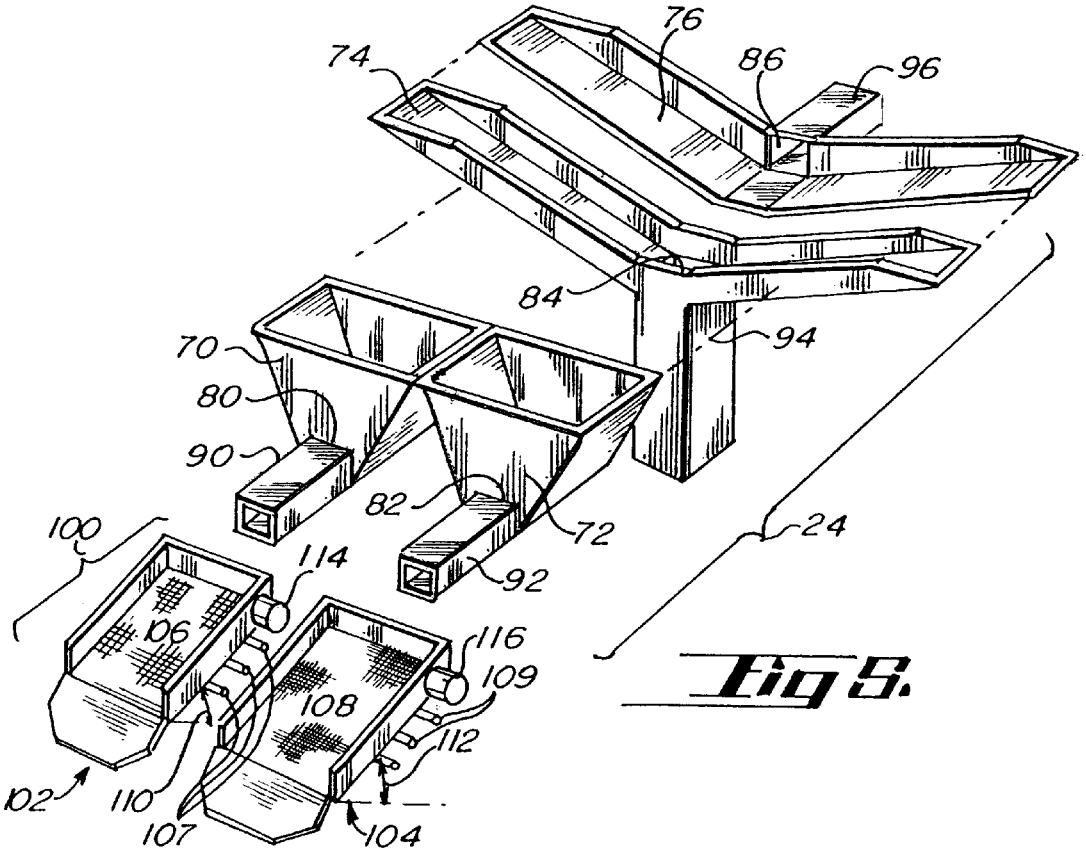
FIG. 5 is a partial, exploded perspective view of the flumes of the discharge system depicting the arrangement of the flumes relative to each other in the preferred embodiment, and the possible directions in which sorted material may be directed; and, FIG. 6 is a schematic sectional view depicting particles that have settled out at the settling stations within the classification tank, and how these particles at the particular settling stations are further processed.
Figure 3:
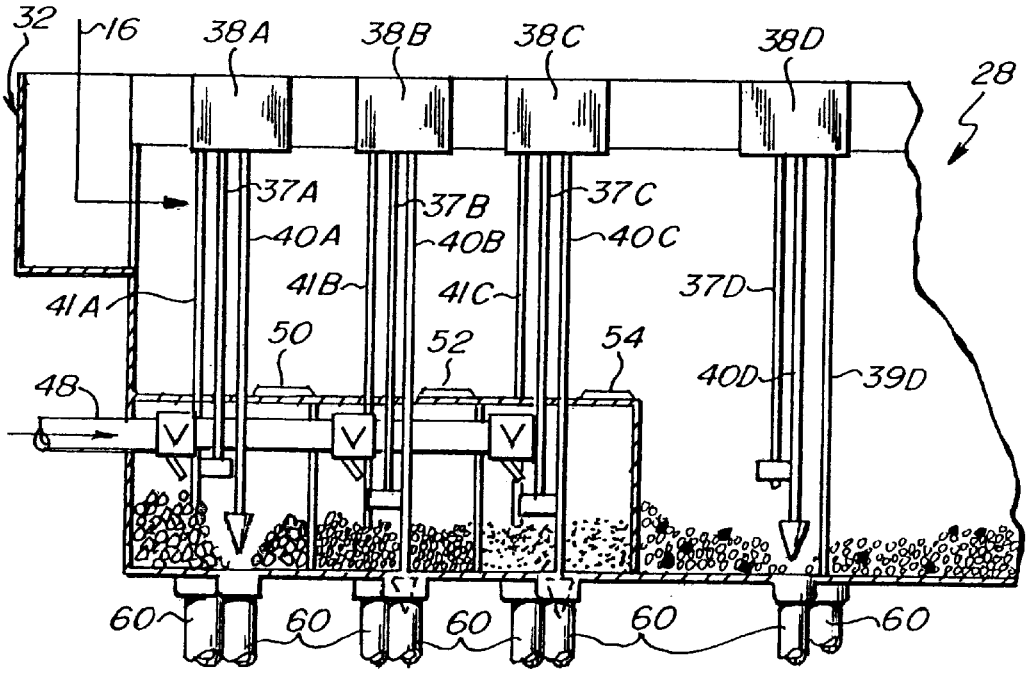

The discharge system 24 of the first stage 20 will now be discussed. With reference to FIGS. 2, 4 and 5, each settling station 36A–J usually includes a cluster of two or three valves as needed, here shown as 39A, 40A, 41A at settling station 36A that are operatively connected to a corresponding number of discharge conduits 60. Each of these discharge conduits 60 drains to one of a plurality of distinct and adjacent flumes 70, 72, 74, 76 positioned beneath the trough 30. As depicted in the exploded view of FIG. 5, these flumes direct the flow of slurry 16 to a second stage 100, or directly to a dewatering unit 120, as the case may be. In the preferred embodiment, the fourth, fifth and sixth settling stations 36D–F have been configured so that they are able to direct slurry 16 to a first flume 70, and the seventh, eighth and ninth settling stations 36G–I have been configured so that they are able to direct slurry 16 to a second flume 72. These flumes 70, 72 are representative of the region or areas in which most of the lightweight deleterious material can be expected to settle, as the larger lightweight material is prevented from settling at the first three settling stations 36A–C by the rising current cells, and the smallest lightweight material often remains in suspension and is carried away by the working fluid through the outlet end 34 of the trough 30. As can be seen, the first and second flumes 70, 72 have outlets 80, 82, respectively, which are operatively connected to conduits 90 and 92, respectively, which direct the discharged material to the second stage 100. The third or middle flume 74 includes an outlet 84 that is operatively connected to a conduit 94, and the fourth flume 76 includes an outlet 86 that is operatively connected to a conduit 96. Particles that are directed through flumes 74 and 76 and into conduits 94 and 96 which lead directly to respective dewatering units 120.

Figure 6:
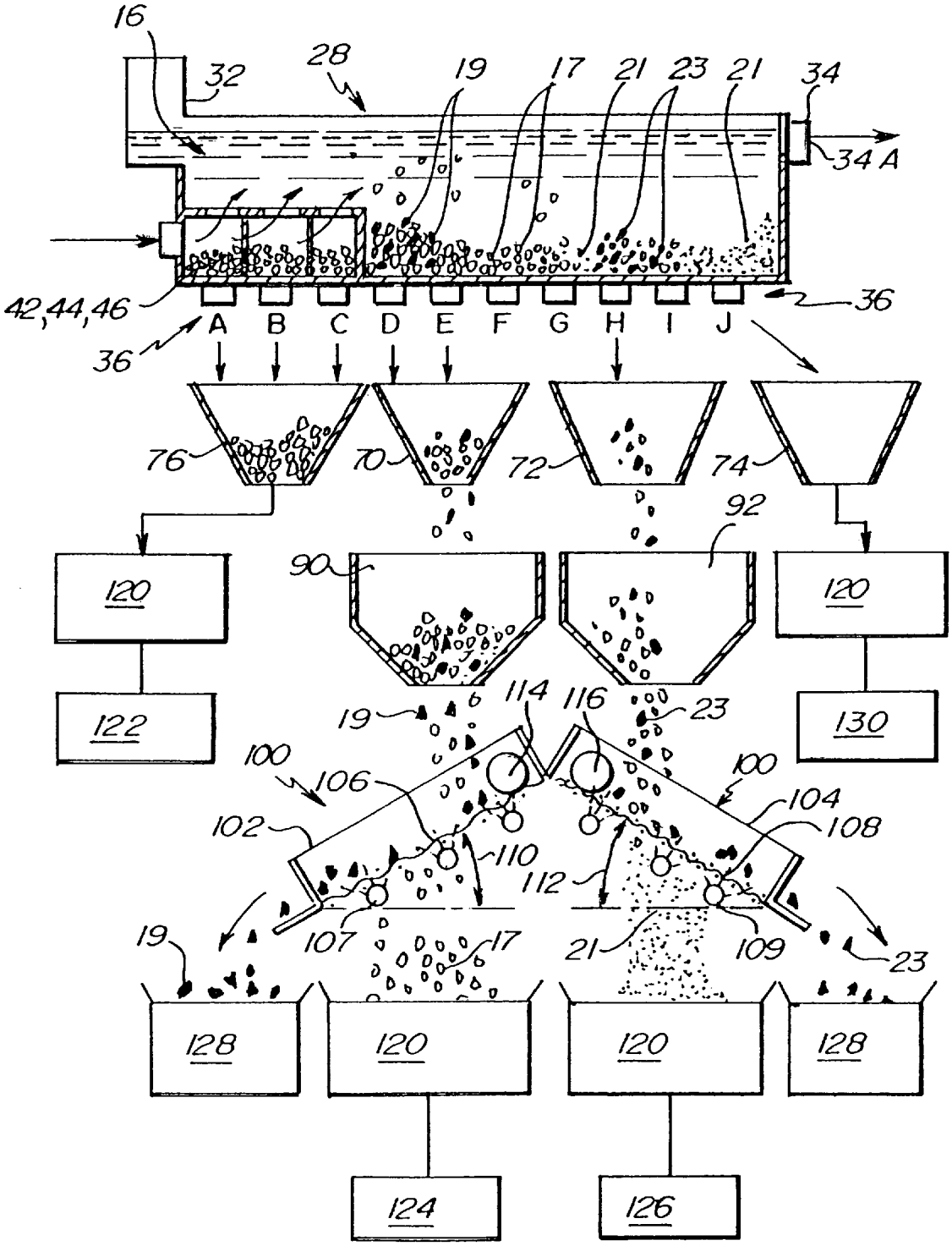

Referring now to FIGS. 2 and 6, where particulate matter is shown as having been deposited at settling stations 36A–J, as depicted, the heaviest sand particles have settled at settling stations 36A–C, with the remaining particles settling out at settling stations 36D–J. Settling stations 36A–C do not include significant lightweight deleterious particles because they have been entrained by the upwelling flow from current cells 42, 44, 46 and carried to subsequent settling stations 36D–J. In this depiction, there are concentrations of lightweight deleterious particles 19, 23 at settling stations 36D, 36E and 36H, respectively. As sufficient material has been collected at settling stations 36A–J, the material is discharged into flumes 76, 70, 72, or 74. The material entering flume 76 from settling stations 36A–C is coarse sand that does not require screening and it is directed to an appropriate dewatering unit 120 and to a subsequent collection area as an end product 122. Similarly, the material entering flume 74 from settling station 36J is predominantly very fine sand particles, suitable for mortar. It may be directed to an appropriate dewatering unit 120 and to a subsequent collection area as an end product 130 having limited use.

Material entering flume 70 from settling stations 36D–F includes predominantly medium-to-somewhat coarse sized sand particles 17 and lightweight coal particles 19. Note that the lightweight coal particles 19 are much larger than the primary sand particles 17. This material requires additional processing and it is directed to the first screen 102 of a second stage 100. There, the material is sorted by screen 102. Preferably, the screen 102 is provided with a variable speed motor(s) 114 that is operatively connected thereto and which may vibrate the screen at predetermined vibrational speeds and amplitudes. The mesh 106 of the first screen 102 is preferably wire cloth having a gauge number size of 16, but this may vary depending upon the situation. The screen 102 may be tilted with respect to the horizontal as shown at angle 110. As shown, the lightweight deleterious particles 19 are separated from the desirable primary material 17, with the desirable primary material 17 being directed to an appropriate dewatering unit 120 and to a subsequent collection area as an end product 124, while the screened lightweight particles 19 are directed to a collection area as unused product 128.

Similarly, material entering flume 72 from settling stations 36G–I includes predominantly medium-to-fine sized sand particles 21 and lightweight deleterious coal particles 23. Note that the lightweight coal particles 23 are much larger than the primary sand particles 21. This material requires additional processing and it is directed to the second screen 104 of a second stage 100. There, the material is sorted by screen 104. As with the first screen 102, the screen 104 is provided with a variable speed motor(s) 116 that is operatively connected thereto and which may vibrate the screen at predetermined vibrational speeds and amplitudes. The mesh 108 of the second screen 104 is preferably wire cloth of a size equal to or smaller than the first mesh 106, but this too may be varied depending upon the situation. The preferred mesh 108 has a gauge number size of 20. As with the first screen 102, the screen 104 may also be tilted with respect to the horizontal as shown at angle 112. As shown, the lightweight particles 23 are separated from the desirable primary material 21, with the desirable primary material 21 being directed to an appropriate dewatering unit 120 and to a subsequent collection area as an end product 126, while the screened lightweight particles 23 are directed to a collection area as unused product 128.

It was only after significant study of the inability of the previous retrofit screening apparatus to effectively separate lightweights from a primary material that the inventors of the present invention determined that the primary reason that the lightweight particles were passing through the specific vibratible screen was due to the vibrational characteristics of the screen itself. The problem discovered was that a standard vibrating screen oscillates at a frequency generated by a motor turning at a speed of 10 about 1000 revolutions per minute (RPM), and the wire cloth of that screen has a certain amplitude of displacement of its wires at that speed. The displacement of the standard screen used in the retrofit apparatus as measured from peak to trough was on the order of one-eighth to three-eighths of an inch. It was observed that this amplitude was excessive for the removal of many lightweight particles such as coal, and movement of the screen itself against these lightweight particles caused these soft lightweight particles to shatter into smaller pieces that slipped through the screen and thus defeated the screening process. This invention addresses this problem by utilizing a high speed, vibrating screen having a higher vibration rate produced by motors turning at speeds between approximately 3000 to 6000 RPM. While this vibration rate produces acceptable results for the entire range, a vibration rate of around 4000 to 5000 RPM will produce better results, and an RPM of around 4500 RPM is preferred. Equally important is the amplitude of wire movement and the ability to adjust and tailor the frequency and amplitude of the screen to each batch of raw material being processed. The amplitude or displacement of the wire in these high vibrational speed screen units 102, 104 (See, FIGS. 5 and 6) is effective around one eighth of an inch or less total travel. While this amplitude produces acceptable results of the entire range, an amplitude of approximately one thirty-second to one sixty-fourth of an inch will produce better results. The ability to vary the motor speed and adapt to specific sorting requirements enhances the throughput and efficiency. Preferably, each screen will have a multiplicity of such motors positioned along the screen with each one having variable speed so as to tune the frequency to achieve an optimum result. This higher frequency vibration has a substantially reduced amplitude of displacement for the wire screen and does not significantly break up the lightweight particles. The particular variable speed screen, which is described here, is a commercially available unit sold by Production Engineered Products, Inc. of Sterling, Ill.

In addition to changing the operational characteristics of the vibrating screens, it has been discovered that the effectiveness of the screening operation may be improved by inclining the angle of the screen with respect to the horizontal. Although the screens 102, 104 may operate effectively in a horizontal orientation, it has been discovered that the screens 102, 104 operate more efficiently when they are inclined with respect to the horizontal at an angle 110 or 112, respectively, in the range of 20–50 degrees and preferably around 40 degrees (See, FIGS. 5 and 6). It will be appreciated that screens 102, 104 need not be tilted at the same angle. That is, the first screen 102 may be substantially horizontal while the second screen 104 is tilted, for example, at forty-five degrees from the horizontal.

The screens 102, 104 also include sprayers 107, 109, respectively. This is not an unusual occurrence as sprayers are commonly associated with screens used in this type of application, and the combination of a screen and a sprayer is often referred to as a wet screen. With the typical prior art wet screen, sprayers are positioned and oriented above the screen so that working fluid exiting therefrom is directed downward towards the screen in the direction concurrent with the slurry being screened. In the present invention, however, the sprayers 107, 109 are positioned and oriented below the first and second screens 102, 104 so that the working fluid exiting therefrom is directed upwards towards and through the mesh 106, 108 of the first and second screens 102, 104 and against the flow of slurries being screened. This departure from the accepted, conventional prior art wet screen is important for several reasons. First, not all of the desirable particles are able to pass through a screen at the same rate as the working fluid. That is, the working fluid of the slurry flows easily past the screen while desirable sand particles sometimes hang-up and adhere to the screen due to surface tension or friction between the sand particles and the mesh of the screen. This reduces the ability and efficiency of a screen to process the slurry passing thereby. It has been found that directing a flow of working fluid from beneath the screen, through the screen and against the flow of a slurry will reduce this adhesion between the desired sand particles and the mesh of the screen and permit them to pass easily therethrough as intended, thus increasing the efficiency of the screen. Another, equally important reason for placing the sprayers beneath the screens is that the flow of working fluid directed up through the screen will discourage undesirable, lightweight particles from being forced through the mesh of the screen. Rather, it has been found that such an upwardly directed flow beneficially assists in the separation process. Ancillary to this benefit is that the upwardly directed flow of working fluid from the sprayers also reduces fracturing of undesirable, lightweight particles against the mesh of the screen, thereby preventing the lightweight deleterious particles from becoming small enough to pass through the mesh of a screen.

A brief description of the operation will now be described. In operation, a slurry 16 is directed to the processing apparatus 18 that includes a first stage 20 and a second stage 100. As the slurry 16 enters the trough 30 of the first stage 20, the heavier particles settle at the first three settling stations 36A–C. Normally, one might expect that some lightweight particles may settle at the first few settling stations. However, with the use of rising current cells (42, 44, 46) this may be greatly reduced or eliminated. Moreover, those lightweight deleterious particles which are propelled past the first few settling stations will be easier to separate from the primary sand particles which have accumulated at subsequent settling stations 36D–I. The end result is that lightweight particles are deposited in predetermined settling stations along the trough 30. Periodically, the depositions at the settling stations 36D–I are observed and/or tested to determine if they contain lightweight material in excess of a predetermined level. When the lightweight material at the settling stations reaches the predetermined level, the material at those settling stations is directed to a second stage 100 for further processing. The second stage includes at least one or more motorized, vibratable screens that are equipped with a sprayer that directs a flow of fluid in an upward direction through the screens and against the flow of the material being screened, and which are used to separate lightweight deleterious material from desired primary sand particles. Preferably, the tilt angle and the vibrational characteristics of each screen may be adjusted to optimize performance. As the material is screened, the desirable primary sand particles pass through the mesh of the screens and are directed to a dewatering station 120 and collection areas 124. 126. The lightweight deleterious material, prevented from passing through the mesh by the vibrational characteristics and the sprayer for each screen, is shunted away from the screens to another collection area 128.

In the case where the material which settles at settling stations does not include lightweight deleterious material, as is to be expected at settling stations 36A–D and 36J, the material is directed to an appropriate dewatering unit 120 and end product collection areas 122, 130.

Thus described, this invention provides an efficient and effective apparatus and method for separating lightweight, low density material such as coal from higher density, primary, material destined for use in concrete and/or mortar.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A method of sorting a mixture of particles by size and weight, the method comprising the steps of:

a. combining the mixture with a working fluid to form a slurry;

b. introducing the slurry into the inlet of a classification tank having an inlet, an outlet, and a plurality of settling stations located therebetween, with each settling station having at least one discharge valve;

c. adjusting the flow rate of the slurry as it traverses from the inlet to the outlet of the classification tank to allow particles of similar weight to settle out of the working fluid in a continuum at the settling stations;

d. identifying those settling stations of the classification tank at which particles that have settled have significant variation in particle size;

e. discharging the particles at the identified settling stations through the discharge valves associated with the identified settling stations;

f. directing the particles discharged through the at least one discharge valve to a screen; and, g. sorting the discharged particles with the screen causing particles having substantially different sizes to be effectively separated from each other.

2. The method of claim 1, wherein the step of sorting the discharged particles with the screen causing particles having substantially different sizes to be effectively separated from each other comprises the step of:

vibrating the screen at a predetermined frequency and a predetermined amplitude.

3. The method of claim 2, wherein the step of vibrating the screen at a predetermined frequency and a predetermined amplitude comprises the step of:

vibrating the screen with a motor turning at a frequency between three thousand and six thousand revolutions per minute and with an amplitude of displacement not substantially exceeding one eighth of an inch of total travel.

4. The method of claim 1, wherein the step of sorting the discharged particles with the screen causing particles having substantially different sizes to be effectively separated from each other comprises the step of:

vibrating the screen with a motor turning at a frequency between three thousand and six thousand revolutions per minute.

5. The method of claim 1, wherein the step of sorting the discharged particles with the screen causing particles having substantially different sizes to be effectively separated from each other comprises the step of:

vibrating the screen with a motor turning at a frequency between four thousand and five thousand revolutions per minute.

6. The method of claim 1, wherein the step of sorting the discharged particles with the screen causing particles having substantially different sizes to be effectively separated from each other comprises the step of:

vibrating the screen with a motor turning at a frequency of about four thousand five hundred revolutions per minute.

7. The method of claim 1, wherein the step of sorting the discharged particles with the screen causing particles having substantially different sizes to be effectively separated from each other comprises the step of:

vibrating the screen at an amplitude of displacement not exceeding one-eighth of an inch of total travel.

8. The method of claim 1, wherein the step of sorting the discharged particles with the screen causing particles having substantially different sizes to be effectively separated from each other comprises the step of:

vibrating the screen at an amplitude of displacement between one-eighth of an inch and one sixty-fourth of an inch of total travel.

9. The method of claim 1, wherein the step of sorting the discharged particles with the screen causing particles having substantially different sizes to be effectively separated from each other comprises the step of:

vibrating the screen at an amplitude of displacement between one thirty-second and one sixty-fourth of an inch of total travel.

10. The method of claim 1, wherein the step of sorting the discharged particles with the screen causing particles having substantially different sizes to be effectively separated from each other further comprises the step of:

introducing a flow of working fluid through the screen in a generally upwardly direction.

11. The method of claim 2, wherein the step of vibrating the screen at a predetermined frequency and a predetermined amplitude further comprises the step of:

introducing a flow of working fluid through the screen in a generally upwardly direction.

12. The method of claim 1, wherein the step of adjusting the flow rate of the slurry as it traverses from the inlet to the outlet of the classification tank comprises the steps of:

i. positioning a current classifier cell having an intake and an exhaust grate adjacent the input end of the classification tank;

ii. introducing a flow of working fluid into the intake of the classifier cell; and, iii. directing the flow of working fluid in the classifier cell through the exhaust grate and into the slurry flow, with the flow exiting the exhaust grate having sufficient velocity to prevent settling of lightweight particles from said slurry flow thereagainst while allowing heavier particles from said slurry flow to overcome the flow exiting the exhaust grate and settle within the classifier cell.

13. The method of sorting a mixture of particles by size and weight of claim 1, wherein the working fluid is a liquid.

14. A method of sorting a mixture of particles according to size and weight, the method comprising the steps of:

a. combining the mixture with a working fluid to form a slurry;

b. introducing the slurry into a classification tank having an inlet, an outlet, and a plurality of settling stations located therebetween;

c. adjusting the flow rate of the slurry as it traverses from the inlet to the outlet of the classification tank to allow particles of similar weight to settle out of the working fluid in accord with a deposition gradient at the settling stations;

d. identifying those portions of the deposition gradient which have significant variation in particle size;

e. discharging the identified portions of the deposition gradient having significant variation in particle size from those settling stations in closest proximity thereto;

f. directing the discharged portions to a screen angled with respect to the horizontal; and, g. sorting the discharged portions with the screen causing particles having substantially different sizes to be effectively separated from each other.

15. The method of claim 14, wherein the angle of the screen with respect to the horizontal is between twenty and fifty degrees.

16. The method of claim 15, wherein the step of sorting the discharged particles with the screen causing particles having substantially different sizes to be effectively separated from each further comprises the step of:

introducing a flow of working fluid through the screen in a generally upwardly direction.

17. The method of claim 14, wherein the step of sorting the discharged particles with the screen causing particles having substantially different sizes to be effectively separated from each other comprises the step of:

vibrating the screen at a predetermined frequency and a predetermined amplitude.

18. The method of claim 17, wherein the step of vibrating the screen at a predetermined frequency and a predetermined amplitude further comprises the step of:

introducing a flow of working fluid through the screen in a generally upwardly direction.

19. The method of claim 17, wherein the step of vibrating the screen at a predetermined frequency and a predetermined amplitude comprises the step of:

vibrating the screen with a motor turning at a frequency between three thousand and six thousand revolutions per minute at an amplitude not substantially exceeding one-eighth of an inch of total travel.

20. A method of sorting a mixture of particles which are insoluble in a working fluid, such sorting being by size and weight, the method comprising the steps of:

a. combining the mixture with a working fluid to form a slurry;

b. introducing the slurry into the inlet of a classification tank having an inlet, an outlet, and a plurality of settling stations located therebetween, with each settling station having at least one discharge valve;

c. adjusting the flow rate of the slurry as it traverses from the inlet to the outlet of the classification tank to allow particles of similar weight to settle out of the working fluid in a continuum at the settling stations;

d. identifying those settling stations of the classification tank at which particles that have settled have significant variation in particle size;

e. discharging the particles at the identified settling stations through the at least one discharge valve associated with the identified settling stations;

f. directing the particles discharged through the at least one discharge valve to a plurality of screens; and, g. sorting the discharged particles with said plurality of screens causing particles having substantially different sizes to be effectively separated from each other.

21. The method of claim 20 wherein the step of sorting the discharged particles with said plurality of screens causing particles having substantially different sizes to be effectively separated from each other comprises the step of:

vibrating the screens at a predetermined frequency and a predetermined amplitude.

22. The method of claim 21, wherein the step of vibrating the screens at a predetermined frequency and a predetermined amplitude comprises the step of:

vibrating the screens with motors turning at a frequency between three thousand and six thousand revolutions per minute at an amplitude not substantially exceeding one-eighth of an inch of total travel.

23. The method as in claim 20, 21, or 22, wherein the plurality of screens have different mesh sizes.

24. A method of sorting a mixture of particles which are insoluble in a working fluid, such sorting being by size and weight, the method comprising the steps of:

a. combining the mixture with a working fluid to form a slurry;

b. introducing the slurry into a classification tank having an inlet, an outlet, and a plurality of settling stations located therebetween, with each settling station having at least one discharge valve;

c. adjusting the flow rate of the slurry as it traverses from the inlet to the outlet of the classification tank to allow particles of similar weight to settle out of the working fluid in a continuum at the settling stations;

d. identifying those settling stations of the classification tank at which particles that have settled have significant variation in particle size;

e. discharging the particles at said identified settling stations through the at least one discharge valve associated with said identified settling stations;

f. directing the particles discharged through the at least one discharge valve to a plurality of screens, with at least one of said screens angled with respect to the horizontal; and, g. sorting the discharged particles with said plurality of screens causing particles having substantially different sizes to be effectively separated from each other.

25. The method of claim 24 wherein the step of directing those particles discharged through the at least one discharge valve to a plurality of screens with at least one of said screen angled with respect to the horizontal comprises the step of:

vibrating the screens at predetermined frequencies and at predetermined amplitudes.

26. The method of claim 25, wherein the step of vibrating the screens at predetermined frequencies and at predetermined amplitudes comprises the step of:

vibrating the screens with motors turning at a frequency between three thousand and six thousand revolutions per minute at an amplitude not substantially exceeding one-eighth of an inch of total travel.

27. The method as in claim 24, 25, or 26, wherein the screens have different mesh sizes.

28. An apparatus for sorting a mixture of particles which are insoluble in a working fluid, such sorting being by size and weight, the apparatus comprising:

a classification tank having an inlet, an outlet, and a plurality of settling stations therebetween;

a plurality of flumes, each operatively positioned relative to said classification tank to receive particles discharged from said settling stations of said classification tank, said flumes configured to direct the received particles to a plurality of processing areas, with one of said processing areas including a vibratable screen; wherein, particles come out of suspension and settle out by weight at said settling stations in said classification tank as the slurry traverses said classification tank from said inlet to said outlet, and wherein said settling stations having a significant variation in particle sizes are discharged to a said flume and directed to said processing area having said vibratable screen.

29. The apparatus of claim 28 further comprising a current classifier cell having an intake and an exhaust grate, with the current classifier cell configured to direct a flow of working fluid though the exhaust grate and into a flow of slurry at a flow rate sufficient to prevent settling of lightweight particles from the flow of slurry thereagainst while allowing heavier particles from the flow of slurry to overcome the flow exiting the exhaust grate and settle in the classifier cell.

30. The apparatus of claim 29, wherein the exhaust grate of the current classifier cell is adjustable.

31. The apparatus of claim 28, further comprising a second vibratable screen at a second processing area.

32. The apparatus of claim 28, wherein said screens are vibrated by motors turning at a frequencies of between three thousand and six thousand revolutions per minute, and wherein the amplitude of screen displacement does not substantially exceed one-eighth of an inch of total travel.

33. The apparatus of claim 28, further comprising a sprayer, the sprayer positioned and oriented beneath the vibratable screen so as to direct a flow of working fluid in a generally upwardly direction through the screen; wherein, the generally upwardly directed flow of working fluid facilitates passage of particles through the vibratable screen.

34. An improved particulate material sorting apparatus of the type having a classifying tank for separating particles based on their relative weights, said apparatus having a plurality of settling stations which are operatively connected to a plurality of flumes which direct particulate material deposited in said tank to a plurality of collection areas; the improvement comprising;

at least one screen being operatively interposed between one of said flumes and one of said collection areas, said screen being sized to separate particles of a first size from particles of a second, smaller size.

35. The improved particulate material sorting apparatus of claim 34, further comprising:

a second screen being operatively interposed between a second one of said plurality of flumes and another one of said plurality of collection areas, said second screen being sized to separate particles of a first size from particles of a second, smaller size.

36. The improved particulate material sorting apparatus of claim 34, wherein the screen vibrates by a motor turning at a frequency of between three thousand and six thousand revolutions per minute.

37. The improved particulate material sorting apparatus of claim 34, wherein the screen vibrates with an amplitude not substantially exceeding one-eighth of an inch of total travel.

38. The improved particulate material sorting apparatus of claim 34, further comprising a sprayer, the sprayer positioned and oriented beneath said vibratable screen so as to direct a flow of working fluid in a generally upwardly direction through the screen; wherein, the generally upwardly directed flow of working fluid facilitates passage of particles through the vibratable screen.

39. An improved sand sorting apparatus of the type having a classifying tank for separating particles based on their relative weights, said apparatus having a plurality of settling stations which are operatively connected to a plurality of flumes which direct particulate material deposited in said tank to a plurality of collection areas; the improvement comprising:

at least one screen being operatively interposed between one of said flumes and one of said collection areas, said screen being sized to separate particles of a first size from particles of a second, smaller size.

40. The improved sand sorting apparatus of claim 39, further comprising:

a second screen being operatively interposed between a second one of said plurality of flumes and another one of said plurality of collection areas, said second screen being sized to separate particles of a first size from particles of a second, smaller size.

41. The improved sand sorting apparatus of claim 39, wherein the screen vibrates by a motor turning at a frequency of between three thousand and six thousand revolutions per minute.

42. The improved sand sorting apparatus of claim 39, wherein the screen vibrates with an amplitude of displacement not substantially exceeding one-eighth of an inch of total travel.

43. The improved sand sorting apparatus of claim 39, further comprising a sprayer, the sprayer positioned and oriented beneath the vibratable screen so as to direct a flow of working fluid in a generally upwardly direction through the screen; wherein, the generally upwardly directed flow of working fluid facilitates passage of particles through the vibratable screen.

* * * * *